US005259359A

United States Patent [19]

Meredith

[11] Patent Number: 5,259,359

[45] Date of Patent: Nov. 9, 1993

[54] ARROW RELOADING DEVICE

[76] Inventor: Mark Meredith, 931 Indian Church Rd., West Seneca, N.Y. 14224

[21] Appl. No.: 933,296

[22] Filed: Aug. 21, 1992

[51] Int. Cl.[5] ..... F41B 5/14

[52] U.S. Cl. ..... 124/25.5; 124/44.5; 124/86

[58] Field of Search ..... 124/23.1, 24.1, 25.5, 124/25.7, 44.5, 86, 88

[56] References Cited

U.S. PATENT DOCUMENTS

| | | | |
|---|---|---|---|
| 2,999,620 | 9/1961 | Haggard . | |
| 3,017,874 | 1/1962 | Gubash . | |
| 3,244,161 | 4/1966 | Jenson | 124/44.5 X |
| 3,286,961 | 11/1966 | Mandolare | 124/25.7 X |
| 3,595,214 | 7/1971 | O'Malley et al. . | |
| 3,896,782 | 7/1975 | Carella | 124/44.5 |
| 4,247,027 | 1/1981 | Tardiff | 224/197 |
| 4,541,403 | 9/1985 | DeBlois . | |
| 4,662,346 | 5/1987 | Laffin | 124/44.5 |
| 4,823,762 | 4/1989 | Pugh | 124/52 |
| 4,869,226 | 9/1989 | Wu . | |
| 4,955,355 | 9/1990 | Pugh | 124/52 |
| 5,107,819 | 4/1992 | Pugh | 124/52 |

*Primary Examiner*—Randolph A. Reese
*Assistant Examiner*—John Ricci
*Attorney, Agent, or Firm*—Bean, Kaufmann & Spencer

[57] ABSTRACT

An arrow reloading device, for mounting on an archery bow, is disclosed comprising a flexible support shaft, having a first end configured for attachment to a hand grip portion of a bow and a second end having an arrow holding means, the flexible shaft being of sufficient length to permit positioning the arrow holding means, by flexing the shaft. to a position where an arrow is held ready for reloading the bow.

10 Claims, 2 Drawing Sheets

ARROW RELOADING DEVICE

The present invention relates to archery, particularly to a device mounted to a bow for storing arrows in a position convenient for minimum motion reloading.

BACKGROUND OF THE INVENTION

In the sport of bow hunting, it is generally necessary to get as close as possible to the quarry in order to assure that the arrow finds its mark. In the hunting environment, it is not unusual for a bow hunter to be required to stand in a still position to avoid detection by the quarry, and in many instances movement that may be necessary to load or reload a bow is detected by the quarry and the opportunity to shoot is lost. Loading or nocking an arrow, or reloading an arrow after a missed shot, typically requires movement by the hunter which can easily be detected by the quarry. Thus, it is desirable to have a convenient means and position for storing arrows which allows the bow hunter to load or reload a bow with minimum detectable movement.

The prior art is replete with various quiver means for storing arrows on a bow and various devices for reloading arrows. Typically quiver means store the arrows in an arrangement parallel to the longitudinal axis of the bow and require significant movement of the hunter's arm and hand in order to remove the arrow from the quiver and reload the bow.

Arrow reloading means of the prior art typically maintain several arrows in a complex mechanical apparatus that requires multiple moving parts to function. Some reloading means hold arrows parallel to the bow and movement to a reloading position is easily detected. Many of such means make mechanical sounds when they are functioning, that are distinct from the environmental background sounds and are easily detected by the quarry. Such complex means are subject to malfunction because of the dirt and rough handling imposed upon the equipment in field use.

It is an object of this application to provide a detachable means for convenient storage of arrows on a bow in a position amenable to rapid reloading.

Another object of the application is to provide a means that allows reloading a bow with minimum hunter movement.

A still further object of the invention is to provide a light weight, non-complex device, that is adaptable for attachment to any size archery bow which will provide suitable arrow storage and allow reloading of an arrow with minimum hunter movement.

These and other objects of the invention will be apparent from the following description of the invention.

SUMMARY OF THE INVENTION

The instant invention relates to an arrow holding and reloading device which can be conveniently mounted on an archery bow to hold arrows in a convenient and ready position for reloading. The device comprises a flexible support shaft, that has a first end configured for removable attachment to the bow about the hand grip portion. The other end of the shaft has a holding means for detachably holding one or more arrows in storage. The flexible shaft is of a length sufficient to permit positioning the arrow holding means, by flexing the shaft, from a position of arrow storage to a position, generally perpendicular to the longitudinal axis of the bow, wherein an arrow can be nocked with minimum movement by an archer.

Typically, archer's bows comprise a hand grip portion, which constitutes the middle of the bow, and resilient limb portions which extend from opposite ends of the hand grip portion. The end of the limb portion has means such as nocks, wheels or the like to engage a bowstring. Modern bows generally have a mounting hole, in or about the hand grip portion of the bow, for attaching various accessories which may be used by an archer. The device of the instant invention is configured to be mounted, preferably at or about the hand grip portion and most preferably at such accessory hole, to allow balance of the bow when in use.

The flexible support shaft of the invention is of a material or configuration that provides relative non-resiliency. By relative non-resiliency is meant that upon being flexed to a position the shaft will stay at or about that flexed position until it is flexed to another position. Shafts for such purpose are generally commercially available and typically are manufactured of bendable materials such as malleable metals, deformable plastics or the like, or, are configured to a bendable form, such as metal flexible hose, which maintains its configuration when flexed.

Typically, flexible metal hose that is relatively non-resilient is of corrugated or interlocked type construction and is manufactured of steel, metal alloys or a variety of other materials. The corrugated type hose is usually of an annular or helical configuration and may be covered with a metal braid for added strength. The interlocked type is typically of helical configuration. It is preferred that the flexible shaft of the device of the invention be configured from flexible metal hose of the corrugated construction.

Mounting of the flexible shaft to the bow is generally preferred to be at or about the hand grip portion of the bow in order to maintain bow balance for shooting. In one configuration of the invention, the flexible shaft has an attachment end comprising a means by which the flexible shaft can be mounted to the bow at the accessory hole. Such means can include a hole for bolt mounting of the shaft, a shaft that is insertable through the hole or the like.

In another configuration of the invention, the flexible shaft has an attachment end comprising a clamping means by which the flexible shaft can be mounted to the grip portion or even a limb of the bow. It should be understood that the invention contemplates diverse means of attachment of the flexible shaft to the bow or even mounting to accessories that might in turn be attached to the bow.

The arrow holding means is configured to hold at least one arrow and may be configured to hold two or even several arrows for reloading. Generally it is preferred that the means for holding an arrow be as non-complex as possible so that it will not be significantly effected by the dirt or rough handling of the hunting environment and can be easily cleaned and/or maintained. Generally it is preferred that resilient clips be used to hold the arrow(s) in releasable frictional engagement.

In one embodiment of the invention an arrow is held by a resilient clip that is mounted to a support base that in turn engages the flexible shaft. Two or more such clips can be arranged to engage an arrow at a spaced interval along its shaft such that the arrow will be released by an archer gripping the shaft with a finger and/or thumb and/or by forcibly inserting a finger and/or thumb between the arrow and the clip mounting base at a point between the clips.

A mounting base can be detachable from the flexible shaft and resilient clips can be arranged to hold two or more arrows in parallel arrangement. The arrow(s) can be stored on the mounting base detached from the flexible shaft. As the shooting circumstance warrants the hunter can attach the mounting base to the flexible shaft and flex the shaft in the ready or other position.

In a preferred embodiment, an arrow holding means comprises paired, spaced, aligned "U" brackets wherein the interior surface of each "U" is sized to frictionally engage a shaft of an arrow. The paired "U" brackets are mounted to the flexible shaft, or, a mounting base engaging the flexible shaft, so that the opening of one "U" faces in a different direction than the opening of the other, preferably at about 45° to about 135° angle thereto. To mount or release an arrow, the shaft must be moved in a different direction to be frictionally engaged or disengaged by each "U" bracket. Such paired brackets are preferred in that accidental release of an arrow by a single direction force is unlikely.

DETAILED DESCRIPTION OF THE INVENTION

Figure 1:
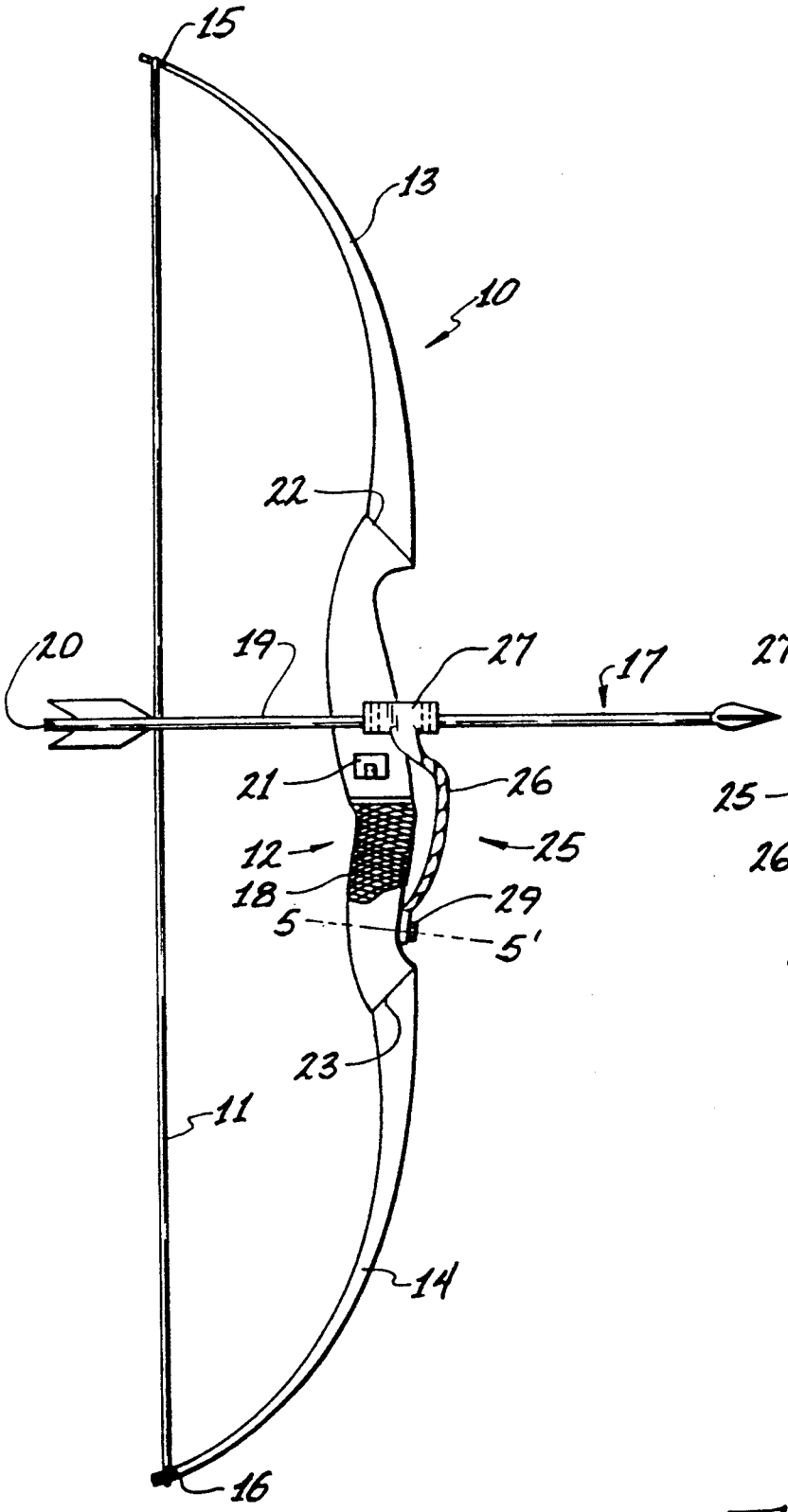
FIG. 1 is a side elevational view of a bow with an arrow reloading device holding an arrow in a ready position in accordance with the invention.
Figure 2:
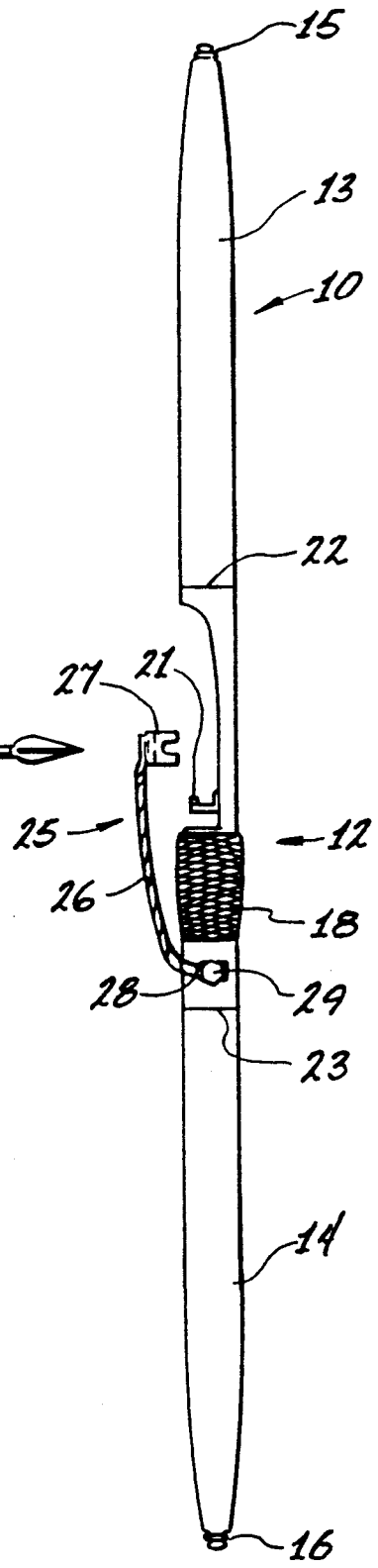
FIG. 2 is a front elevational view of the bow of without the arrow.

Referring now to the drawings, FIGS. 1 and 2 illustrate a conventional archer's bow 10 having a bowstring 11, handgrip portion 12, resilient limbs 13 and 14, and bowstring nocks 15 and 16. Handgrip portion 12 attaches to first and second limbs 13 and 14 at junctions 22 and 23 respectively. Hand grip portion 12 comprises arrow rest 21, on which a nocked arrow can rest for alignment in the shooting position, hand grip 18 which comprises a slip resistant gripping surface, and arrow reloading device 25. The bow of FIG. 1 is depicted with arrow 17 comprising arrow shaft 19, arrow nock 20 and arrow tip. Arrow 17 has been deleted from FIG. 2 for convenience in description.

Figure 5:
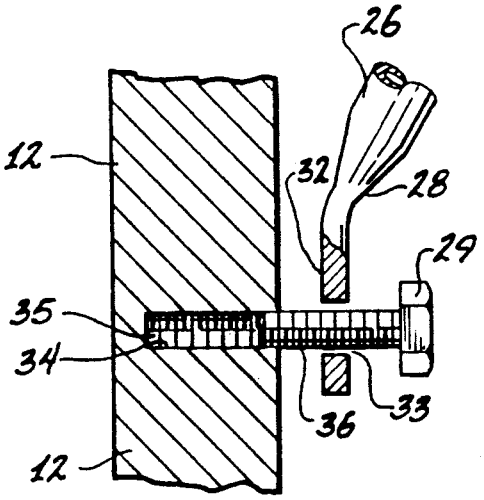
FIG. 5 is an exploded, fragmentary, partial sectional view of the grip portion of the bow of FIG. 1 taken along line 5—5'.

Arrow reloading device 25 comprises non-resilient flexible support shaft 26, arrow holding means 27 and attachment end 28. FIG. 5 shows a partial sectional, fragmentary view of attachment end 28 engaging the accessory hole of the bow of FIG. 1. Therein, attachment end 28 is illustrated as being contiguous with non-resilient flexible support shaft 26 and comprising an end 32 having a hole 33 into which bolt 29 extends, for engagement of threads 36 with opposing threads 34 of accessory hole 35 of hand grip portion 12 of bow 10. It should be understood that an accessory hole may also extend through the bow or be configured without threads, in which circumstance said bolt would comprise a nut for fixing the attachment end to the bow.

Figure 6:
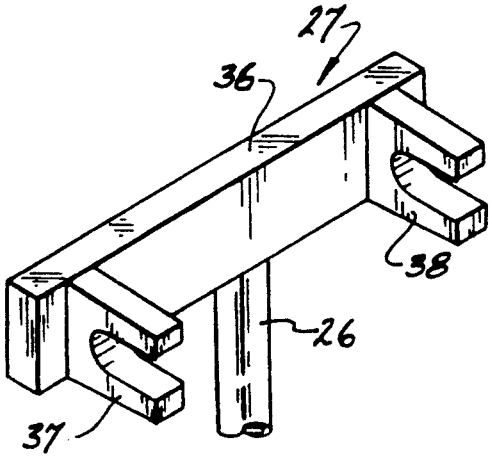
FIG. 6 is a fragmentary, perspective view of the flexible shaft and arrow holding means of FIG. 1.

FIG. 6 shows a perspective view of arrow holding means 27, which engages non-resilient flexible shaft 26. Therein, arrow holding means 27 is shown as comprising mounting base 36 which engages flexible shaft 26. Mounting base 36 comprises spring clips 37 and 38, which are arranged in spaced apart alignment. The spring clips have internal radii, that are sized to grip shaft 19 of arrow 17 but allow ready removal when desired.

In the operation of arrow reloading device, arrow 17 is mounted to arrow holding means 27 by engaging spring clips 37 and 38 with shaft 19. The internal radii of spring clips 37 and 38 are sized such that shaft 19 is removable by manipulation with fingers and/or thumb of the archer.

FIGS. 1 and 2 show the arrow reloading device in a ready to reload position. It should be understood that a reload position can be the same or different for each archer, an advantage of the device of the invention being that reload positioning can be varied as the individual archer desires and as may be convenient to the individuals ability to manipulate a stored arrow. Generally it has been found that the ready to reload position depicted is preferred by hunters in the field, in that a hunter can easily maintain one hand at the grip of the bow and the other at about the bowstring nocking position when reloading an arrow, thus displaying minimum movement to the quarry during the reloading process. By manipulating fingers and/or thumb of the hand around about the grip, the arrow can be removed from the arrow holding means and guided to the arrow rest. The other hand generally grips the nocking end of the arrow and positions nock 19 of the arrow on the bowstring. It has been found that with practice, a first arrow can be shot from the bow and a second arrow loaded and readied to shoot in seconds, with overall hunter movement that is barely perceptible by the quarry.

Figure 3:
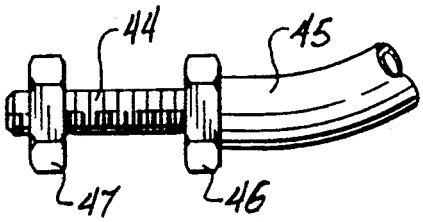
FIG. 3 is a perspective view of a further arrow loading device in accordance with the invention.
Figure 4:
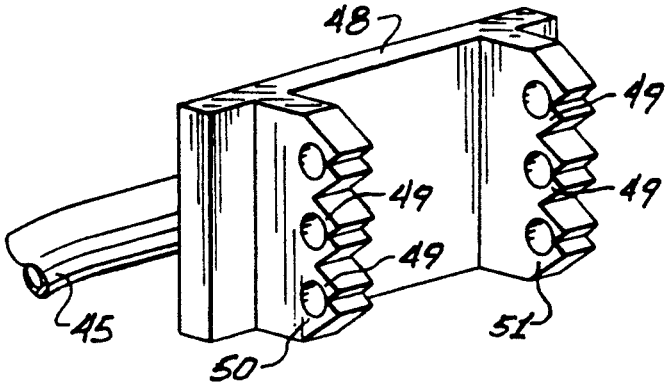
FIG. 4 is a perspective view of another arrow loading device in accordance with the invention.
Figure 4:
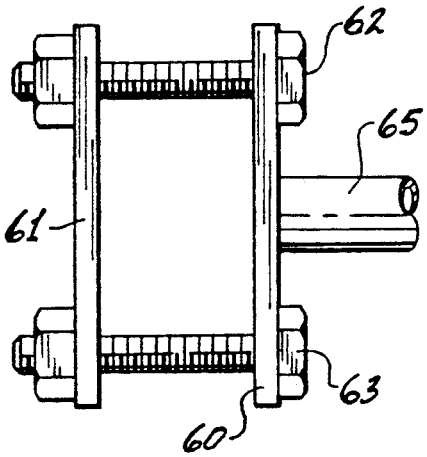
Figure 4:
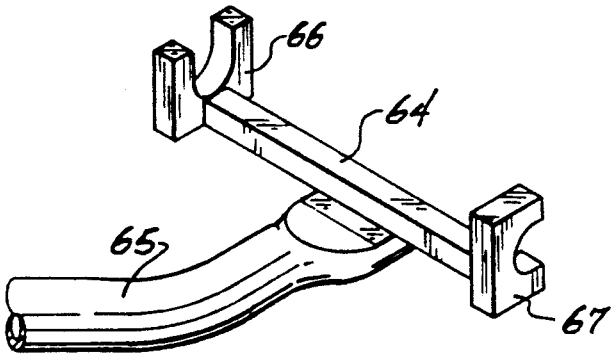

FIGS. 3 and 4 depict further embodiments of the arrow reloading device of the invention. In FIG. 3, an arrow reloading device is shown comprising a threaded stud 44 that extends into an accessory hole of a conventional bow. In an embodiment where the accessory hole extends through the bow, flexible shaft 45 is held in position through tightening of nuts 46 and 47. When the accessory hole does not extend through the bow and is threaded, the stud is locked to the bow using nuts 46 and 47. Mounting base 48, is removably attached to flexible shaft 45 and comprises resilient clips 49 located in rows 50 and 51. The clips are constructed of a material that resiliently engages the shaft of an arrow(s) for frictional engagement thereof, and preferably are molded from an elastomer or the like.

In FIG. 4, an arrow reloading device is shown comprising a clamping means comprising bracket 60, which is attached to flexible shaft 65, and bracket 61. The brackets are aligned and have bolts 62 and 63 extending therebetween to enable clamping the bracket about the grip portion or a limb of the bow by tightening said bolts. Mounting base 64 is attached to flexible shaft 65 and comprises clips 66 and 67 which are aligned so that their openings extend in different directions. The clips are constructed having radii sized to frictionally engage the shaft of an arrow.

It is to be understood that the above detailed embodiments of the invention are provided by way of example only. Various details of design and construction may be modified without departing from the spirit and scope of the invention as set forth in the appended claims.

I claim:

1. An arrow holding and reloading device, for mounting on an archery bow to hold arrows in a convenient and ready position for reloading, comprising a generally non-resilient flexible support shaft, having a first end configured for attachment to said bow and a second end comprising a holding means for detachably holding an arrow; said flexible shaft being of sufficient non-resiliency and length to permit positioning said arrow, by flexing said shaft, from one retained position to another retained position wherein said another position holds said arrow in a ready position for reloading, generally perpendicular to the longitudinal axis of said bow.

2. The device of claim 1 wherein said first end is configured for attachment to an accessory hole in said bow.

3. The device of claim 1 wherein said first end comprises a clamping means.

4. The device of claim 1 wherein said first end comprises an attachment means comprising a hole for attachment to an accessory hole in said bow.

5. The device of claim 1 wherein said first end comprises an attachment means comprising a threaded stud for attachment to an accessory hole in said bow.

6. The device of claim 1 wherein said holding means comprises a clip for engaging a shaft of an arrow.

7. The device of claim 6 wherein said holding means comprises spaced apart clips for engaging a shaft of an arrow.

8. The device of claim 6 wherein said holding means comprises clips for engaging more than one arrow.

9. The device of claim 6 wherein said holding means comprises spaced apart clips wherein the openings thereof face in different directions.

10. The device of claim 1 wherein said arrow is held in a position wherein its nock is proximate the string of an exhausted bow.

* * * * *